United States Patent [19]

Hoffmann

[11] Patent Number: 4,903,439

[45] Date of Patent: Feb. 27, 1990

[54] METHOD FOR GRINDING ROUGH-SHAPED OBJECTS TO A CLEAN SPHERICAL FORM

[75] Inventor: Alfred Hoffmann, Bilthofen, Netherlands

[73] Assignee: SKF Industrial and Trading Development Centre, B.V., Nieuwegein, Netherlands

[21] Appl. No.: 709,844

[22] Filed: Mar. 11, 1985

Related U.S. Application Data

[63] Continuation of Ser. No. 613,103, May 23, 1984, abandoned, which is a continuation of Ser. No. 320,580, Nov. 12, 1981, abandoned.

[30] Foreign Application Priority Data

Dec. 9, 1980 [NL] Netherlands ..... 8006681

[51] Int. Cl.[4] ..... B24B 11/02

[52] U.S. Cl. ..... 51/289 S; 51/26; 51/59 SS

[58] Field of Search ..... 51/289 S, 281 R, 26, 51/292, 59 SS, 59 R, 313, 284 R, 27, 149.5, 67; 29/148.4 B, 148.4 R, 156.5

[56] References Cited

U.S. PATENT DOCUMENTS

| | | | |
|---|---|---|---|
| 525,441 | 9/1894 | Bruner | 51/289 S |
| 537,971 | 4/1895 | Fuller | 51/26 |
| 1,298,261 | 3/1919 | Shoemaker | 51/26 |
| 1,951,080 | 3/1934 | Bartos | 51/28 |
| 2,736,148 | 2/1956 | Thatcher | 51/59 SS |
| 2,850,854 | 9/1958 | Levy | 51/59 SS |
| 2,998,676 | 9/1961 | Hawkins | 51/289 S |
| 3,670,462 | 6/1972 | Robinson | 51/26 X |
| 3,714,703 | 2/1973 | Maples | 51/26 |

FOREIGN PATENT DOCUMENTS

| | | | |
|---|---|---|---|
| 0378975 | 8/1923 | Fed. Rep. of Germany | 51/26 |
| 0148794 | 12/1978 | Japan | 51/26 |
| 0133696 | 10/1979 | Japan | 51/59 SS |
| 0133697 | 10/1979 | Japan | 51/59 SS |
| 0168947 | 6/1959 | Sweden | 51/289 S |
| 0466097 | 7/1975 | U.S.S.R. | 51/289 S |
| 0486896 | 2/1976 | U.S.S.R. | 51/289 S |
| 0675643 | 7/1952 | United Kingdom | 51/289 S |

*Primary Examiner*—Robert Rose
*Attorney, Agent, or Firm*—Eugene E. Renz

[57] ABSTRACT

A method of grinding rough-shaped spherical objects to a finished spherical form comprising the steps of freely supporting the rough-shaped spherical object on one end of a vertically oriented tube. This one end is open and has an inside diameter such that a segment portion of the object lies within the tube. Next, an abrasive is applied to the surface of the object, and the object is ground by vibrating the tube axially at a frequency in the range of approximatelly 20–25 KHz, whereby the surface of the object is ground to a truer spherical shape.

4 Claims, 1 Drawing Sheet

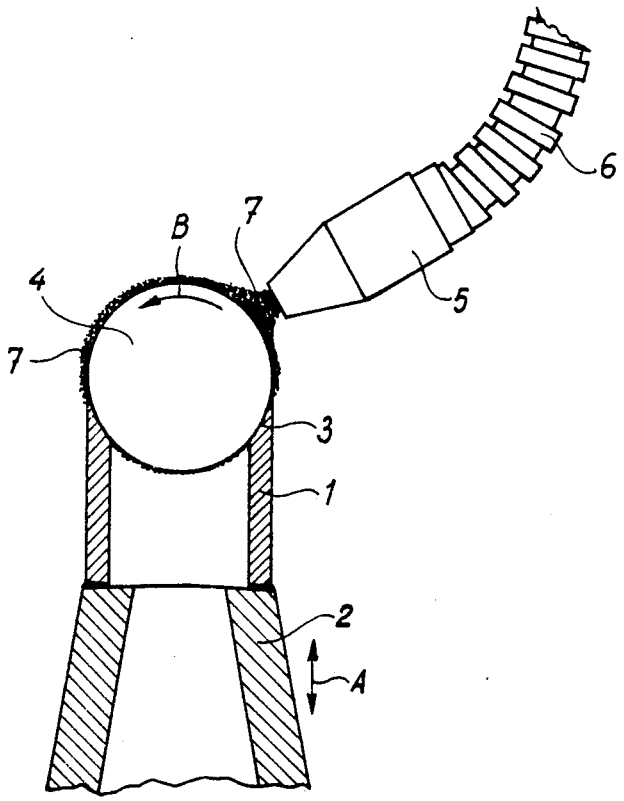
6
7
B
4
5
7
3
1
2
A

METHOD FOR GRINDING ROUGH-SHAPED OBJECTS TO A CLEAN SPHERICAL FORM

This is a continuation of co-pending application Ser. No. 613,103 filed on May 23, 1984, now abandoned, which was a continuation application of Ser. No. 320,580 filed Nov. 12, 1981, now abandoned.

The invention relates to a method of grinding rough-shaped spherical objects to a clean spherical form, in particular objects of a ceramic material.

Spherical objects of a ceramic material, for example a silicon nitride, are often used as the balls of a ball bearing in certain applications. The balls are produced by pressing the starting material, for example powdered silicon nitride mixed with a suitable binder, to a ball in graphite molds at high temperature, or first pressing powdered silicon nitride mixed with a suitable binder to a ball cold and then sintering the ball at high temperature. In either way, however, a spherical object is obtained having too much so-called out-of-round for use as a ball in a ball bearing, so that the object must be afterwards ground to a true spherical shape.

Heretofore, this grinding has been done with the aid of a special grinding machine in which the rough-shaped objects are sometimes processed for more than 24 hours.

The object of the invention is to provide an improved method of grinding rough-shaped spherical objects to a clean spherical shape, wherein the objects are worked more rapidly an with less expenditure of energy.

This object is accomplished in that, by the method according to the invention, the rough spherical object is placed on the top end of a vertical tube, said tube having an inside diameter such that a segment portion of the spherical object lies within the tube, whereupon the tube is vibrated in lengthwise direction and an abrasive is applied to the surface of the object.

The vibrating motion of the tube causes the spherical object placed thereon to rotate in some direction, so that the grinding action of the abrasive between the spherical surface of the object and the inner edge of the tube will gradually impart a clean spherical form to the object.

Preferably the tube is vibrated at a frequency of 20–25 kHz and the annular end face of the tube has a conical shape converging inward.

By creating a negative pressure inside the tube relative to the surroundings, the time required for grinding the object to a true spherical shape can be further reduced.

The invention will be described in more detail with reference to the drawings, showing a device for practicing the process according to the invention.

As shown in the drawing, the device comprises a tube 1 fixed to a vibrating means 2. The upper end 3 of the tube 1 has a conical shape converging inward.

On top of the tube 1, a rough shaped spherical object 4 is placed, so that a segment of the object lies within the tube 1.

If the means 2 is set in vibration in the direction of the double arrow A, the ball 4 rotates in the direction B. By means of a nozzle 5 connected by the hose 6 to a means not shown for supplying an abrasive, the abrasive 7 is applied to the spherical surface of the ball 4, which abrasive exerts a grinding action on the ball 4 between the conical end face 3 of the tube 1 and the spherical surface of the ball 4, whereby the latter is eventually ground to a clean spherical shape.

EXAMPLE

An object 18.3 mm in diameter and 0.2–0.3 mm out of round, made of powdered silicon nitride mixed with 5% yttrium oxide, was placed on the tube 1. The tube was 18.0 mm in outside diameter and 14.5 mm in inside diameter.

The tube 1 was then set in vibration at a frequency of 20–25 kH while the nozzle 5 applied a suspension of 40–50% boron carbide in water to the object. After some time, a few percent of vacuum was set up inside the tube 1.

After 4–5 minutes, the device was stopped and the spherical object removed from the tube 1.

The so-called-out-of-round of the object was found to be within the range of 1–2 $\mu$, while the surface regosity was about 0.4 $\mu$.

What is claimed is:

1. A method of grinding rough-shaped spherical objects to a finished spherical form comprising the steps of:

a. freely supporting the rough-shaped spherical object on one end of a vertically oriented tube, said one end being open and having an inside diameter such that a segment portion of the object lies within the tube;

b. applying an abrasive to the surface of the object; and c. grinding the object by vibrating the tube axially at a frequency in the range of approximately 20–25 KHz, whereby the surface of the object is ground to a truer spherical shape.

2. A method of claim 1, further comprising the step of creating a negative pressure inside said tube, while said tube is being vibrated axially, thereby enhancing the grinding operation.

3. A method of claim 1, wherein the abrasive comprises a suspension of 40–50% boron carbide in water.

4. A method of claim 1, wherein the one end of the vertically oriented tube has a conical shape formed therein which converges inwardly.

* * * * *